US006431142B1

(12) United States Patent
Armatis

(10) Patent No.: US 6,431,142 B1
(45) Date of Patent: Aug. 13, 2002

(54) THROTTLE BLADE HAVING SNAP-FIT WEDGE

(75) Inventor: Ricky Armatis, Onsted, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/679,675

(22) Filed: Oct. 5, 2000

(51) Int. Cl.[7] ..... F02D 9/08
(52) U.S. Cl. ..... 123/337; 137/15.25; 251/308
(58) Field of Search ..... 123/337; 24/453, 24/458; 251/305, 308; 137/15.25; 29/890.124

(56) References Cited

U.S. PATENT DOCUMENTS 1,900,574 A * 3/1933 Meader ..... 24/453
4,644,614 A * 2/1987 Mizusawa ..... 24/453
5,241,451 A * 8/1993 Walburn et al. ..... 24/453
5,599,512 A * 2/1997 Latulippe et al. ..... 24/453
6,003,490 A * 12/1999 Kihara et al. ..... 123/337

* cited by examiner

*Primary Examiner*—Andrew M. Dolinar
*Assistant Examiner*—Arnold Castro
(74) *Attorney, Agent, or Firm*—Brinks Hofer Gilson & Lione

(57) ABSTRACT

A throttle body (12) has a bore (14) through which intake flow passes. A throttle blade (18) is disposed within the bore to selectively restrict the flow. The blade has through-holes (62) extending between its opposite faces (24, 26). A wedge (28) has a body (30) with opposite nonparallel faces (32, 34), one of which is disposed against one face of the blade. Self-attachment features (48) extend from the one face of the wedge body through respective through-holes in the blade. Barbs (52) at the free ends of the self-attachment features catch the opposite face of the blade.

9 Claims, 1 Drawing Sheet

THROTTLE BLADE HAVING SNAP-FIT WEDGE

BACKGROUND OF THE INVENTION

1. Field of the Invention

This invention relates generally to throttles for controlling flow through intake systems of internal combustion engines, and more specifically to a throttle body having a wedge that is snap-fit to a throttle blade.

2. Background Information

Spark-ignited, fuel-injected internal combustion engines enjoy extensive usage as the powerplants of automotive vehicles. A representative intake system for such an engine comprises a throttle body that has a through-bore within which a throttle blade, or throttle plate, also sometimes referred to as a butterfly, is disposed. The throttle blade is fastened to a cylindrical shaft whose axis is substantially coincident with a diameter of the through-bore. The shaft is journaled on opposite wall portions of the throttle body for motion about its own axis. An actuator that is external to the through-bore selectively positions the shaft about its own axis, to thereby selectively position the throttle blade within the through-bore over a range of positions spanning a closed throttle position and a full open throttle position.

Various throttle bodies and throttle blades are documented in patent, and other, literature. A throttle blade may be a flat metal plate that has either a circular or an elliptical shape depending on the angle that the blade makes with the longitudinal axis of the throttle body bore when the blade is in closed position. The closed position of a blade that has a circular shape will be at a right angle to the bore axis while a blade that has an elliptical shape will assume closed position at an angle that is not at a right angle to the bore axis.

It is known to add features to a flat metal blade for imparting certain desired characteristics to a throttle body. For example, a lip seal that is applied to the perimeter of a blade may provide sealing of the blade to the throttle body bore when the blade is closed. It is also known to affix an element to a face of a throttle blade for imparting certain flow restriction characteristics when the blade is open. A wedge that is disposed on the upstream face of a blade is an example of one such element. Heretofore, such elements have been applied by various techniques such as injection molding of synthetic material directly onto blades.

Different engine models may require throttle bodies that have different flow restriction characteristics. Throttle bodies that have blades of the same size can be endowed with different flow restriction characteristics by disposing wedges of different shape and/or size on their blades. Because of the ability to change the flow restriction characteristics of a throttle body simply by changing the shape and/or size of the wedge, different throttle models may share a number of common parts other than the wedges. It is believed that this can provide certain manufacturing advantages to a mass-production maker of throttle bodies.

SUMMARY OF THE INVENTION

The present invention relates to a novel construction for a wedge and how the wedge is associated with a throttle blade of a throttle body. It is believed that the construction provides certain manufacturing advantages because the wedge is fabricated by itself using a suitable process, such as injection molding, and thereafter is associated with a throttle blade without the use of separate fastening devices.

The wedge is disposed on one face of the throttle blade and includes self-attachment features that allow it to snap fit to the throttle blade. The self-attachment features comprise barbed projections that pass from the body of the wedge and through holes in the blade to catch the margins of the holes at the opposite face of the blade. The barbed projections are formed during the molding of a wedge.

Accordingly, a generic aspect of the invention relates to an assembly for selectively restricting intake airflow into an internal combustion engine comprising a throttle body having a bore through which intake flow passes and a throttle blade disposed within the bore for selectively restricting the flow through the bore. The blade comprises one or more through-holes extending between its opposite faces. A wedge comprises a body having opposite non-parallel faces one of which is disposed against one face of the blade. One or more self-attachment features extends from the one face of the wedge body through a respective through-hole in the blade and comprises a barb that catches the opposite face of the blade at the margin of the respective through-hole.

Another generic aspect relates to a wedge for attachment to a throttle blade of a throttle body for selectively restricting intake airflow into an internal combustion engine. The wedge comprises a wedge body having opposite non-parallel faces, one of which is adapted to be disposed against one face of the blade, and one or more self-attachment features that extends from the one face of the wedge body and is adapted to pass through a respective through-hole in the blade, and that comprises a barb adapted to catch the opposite face of the blade around the margin of the respective through-hole.

Still another generic aspect relates to a method of assembling a wedge to a throttle blade. Self-attachment features that extend from a body of the wedge are aligned with through-holes that extend between opposite faces of the blade. The wedge and the blade are advanced relatively toward each other to introduce free distal ends of the self-attachment features comprising barbs into the through-holes and cause the self-attachment features to resiliently flex as the free distal ends are increasingly passed through the through-holes. The advancement continues until the body of the wedge abuts the one face of the blade and the barbs have passed completely through the through-holes so as to allow the flexed self-attachment features to relax and catch the barbs on the margins of the through-holes at the opposite face of the blade.

Other general and more specific aspects will be set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT

Figure 1:
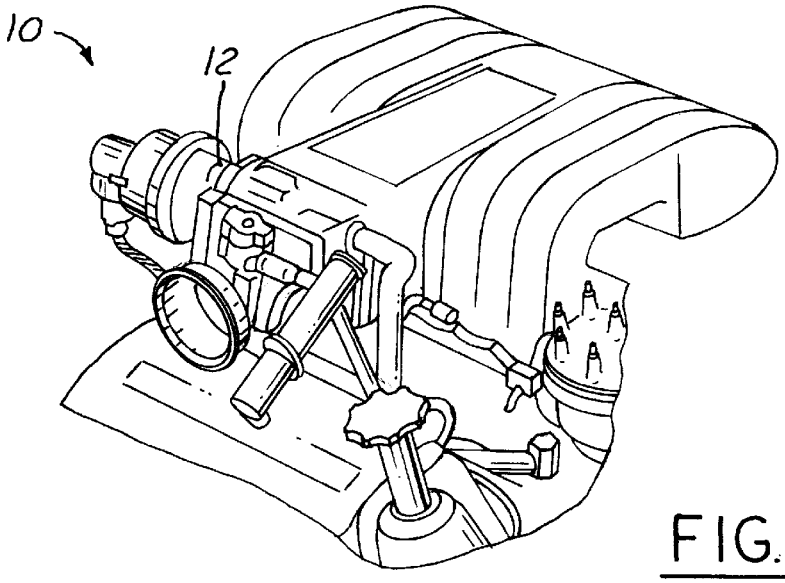
FIG. 1 is a perspective view of an exemplary engine having a throttle body in accordance with principles of the present invention.

FIG. 1 shows an engine 10 having an intake system that includes a throttle body 12 embodying principles of the present invention. Detail of the invention can be seen in S FIGS. 2, 3, and 4 which show throttle body 12 to comprise a bore 14 having an imaginary longitudinal centerline 16. Bore 14 has a nominally circular transverse cross section centered on centerline 16.

A throttle blade 18, alternatively sometimes referred to as a throttle plate or butterfly, is disposed within bore 14 and fastened in an suitable manner to a shaft 20 whose centerline 22 is substantially coincident with a diameter of bore 14. Shaft 20 is cylindrical, and where it spans bore 14, the shaft is shaped in a suitable fashion to provide for mounting and fastening of blade 18 to it. In the particular embodiment illustrated by the drawing, blade 18 is an elliptical metal disk of uniform thickness.

Figure 2:
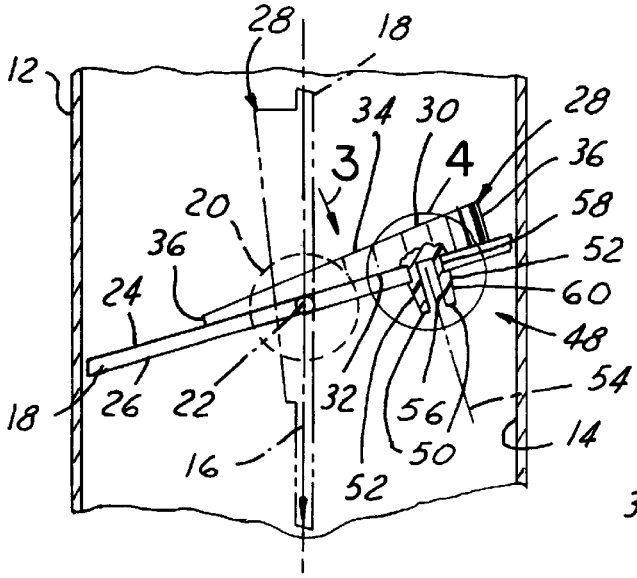
FIG. 2 is a longitudinal cross section view through a portion of the throttle body in the vicinity of a throttle blade containing an exemplary wedge in accordance with principles of the present invention.

FIG. 2 shows blade 18 in closed position. Shaft 20 is journaled on opposite wall portions of throttle body 12 for turning about centerline 22. Shaft 20 is operated by an actuator (not shown) which is operatively connected to a cam, or lever (not shown) affixed to an external end of shaft 20. A single or double coil torsion return spring (also not shown) acts on the exterior of shaft 20 to spring-bias the shaft, and hence blade 18 as well, about centerline 22 to the closed position shown. When the actuator turns the external lever, shaft 20 turns about centerline 22 against the spring bias to selectively turn blade 18 within bore 14. In this way, throttle blade 18 may be selectively positioned over a range of positions spanning the closed throttle position and a full open throttle position shown in phantom.

Figure 3:
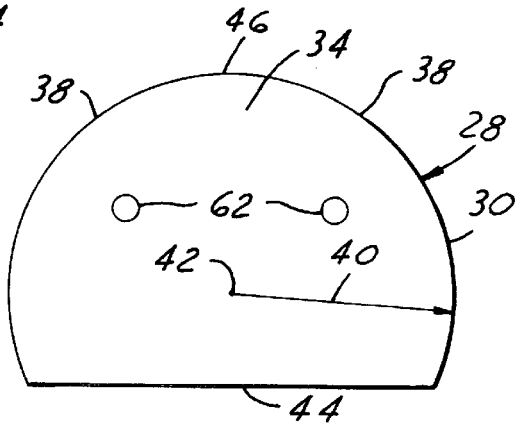
FIG. 3 is a view of the wedge by itself looking along the direction of arrow 3 in FIG. 2.

Blade 18 comprises an upstream face 24 and a downstream face 26. A wedge 28 comprises a body 30 that is disposed on upstream face 24. FIG. 3 shows the plan shape of body 30 to be that of a truncated circle. Opposite faces 32, 34 of the truncated circle are flat, but non-parallel, to endow body 30 with the wedge shape shown in FIG. 2. Body 30 also has a perimeter face 36 that joins faces 32, 34.

FIG. 3 shows that perimeter face 36 has two distinct segments. One is a circular contoured, or at least a substantially circular contoured, segment 38 that is disposed at substantially a constant radius 40 from a center 42 and spans less than a full circle. The other is a straight segment 44 that forms the truncation. The height, i.e. thickness, of body 30 along the length of segment 44 of perimeter face 36 is uniform. From the opposite ends of segment 44, the thickness of body 30 progressively increases along segment 38 to the midpoint 46 of segment 38 where the thickness is a maximum. Midpoint 46 is at a location which is substantially equidistant from opposite ends of the diameter of bore 14 on which centerline 22 is substantially disposed.

Body 30 is disposed on blade 18 to place segment 38 slightly inward from the edge of the blade and with the point of maximum thickness 46 farthest from shaft centerline 22.

Wedge 28 is fabricated by injection molding an appropriate synthetic material, i.e. plastic, in a mold. Multiple wedges may be simultaneously fabricated using a multi-cavity mold.

Figure 4:
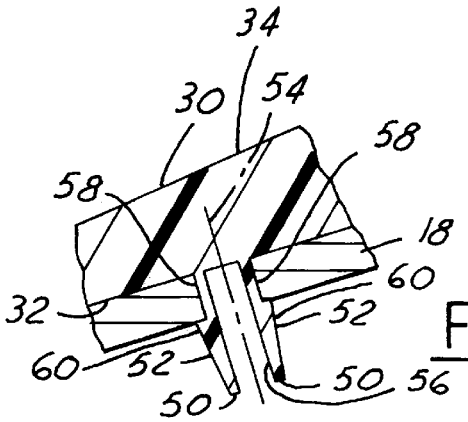
FIG. 4 is an enlarged view in circle 4 of FIG. 2.

Wedge 28 includes self-attachment features 48 that enable it to be associated with blade 18 without the use of separate fasteners. The self-attachment features 48 are formed as integral formations with body 30 during injection molding of wedge 28. The enlarged scale of FIG. 4 shows that each self-attachment feature 48 comprises two barbed projections 50 that extend from face 32 of body 30 perpendicular to that face. Each projection 50 has a distal free end that comprises a barb 52. Each of the two projections 50 of each self-attachment feature 48 is essentially the mirror image of the other about an imaginary medial plane 54. Each projection has an inner face 56 toward, and spaced from, plane 54, and a rounded outer face 58 opposite its inner face. The inner faces may be flat or concave. Each barb 52 protrudes outward from the corresponding rounded face 58, and the outer face 60 of each barb 52 is both rounded and tapered. Each self-attachment feature 48 is disposed to a respective side of an imaginary plane that passes through the point of maximum thickness 46 of the substantially circular contoured segment of the perimeter face perpendicular to centerline 22.

Blade 18 comprises two through-holes 62 whose centerlines are located to register with the centerlines of self-attachment features 48. The process of assembling wedge 28 and blade 18 comprises disposing the wedge over face 24 of blade 18 with self-attachment features 48 aligned with through-holes 62. The process continues by advancing the wedge toward the blade to insert the free ends of projections 50 of each pair into through-holes 62. The rounded and tapered outer face 60 of the two barbs of each projection wipes across the edges of through-holes 62 at face 24. Continued advancement of the wedge forces the free ends of the projections of each pair inwardly toward each other, flexing the two projections. Just as barbs 52 fully emerge from through-holes 62 at blade face 26, wedge face 32 is fitting flat against blade face 24. With the barbs clear of the through-holes, the inherent resiliency of projections 50 causes them to relax and spread apart, thereby catching barbs 52 on the margins of through-holes 62 at blade face 26. This completes the secure assembly of the wedge to the blade.

When shaft 22 is turned counterclockwise in FIG. 2 to move blade 18 away from the closed position, intake air can flow through bore 14. In general, the flow will split as it passes across blade and wedge, and for a given blade and wedge, the flow restriction will be a function of the extent to which the shaft is turned.

The presence of a wedge on the blade acts to restrict the flow in a different way than if the flat blade alone were present. Wedges having different shapes and/or sizes will create different flow restriction characteristics. Hence, a change in the flow restriction characteristic of a throttle body can be accomplished simply by changing a wedge from one size and shape to a wedge of a different size and/or shape. Wedge 28 may be fabricated from any of a various plastics. Such plastics should be fuel-tolerant and dimensionally stable over a range of temperatures typically encountered by a throttle body when in use.

While a presently preferred embodiment has been illustrated and described, it is to be appreciated that the invention may be practiced in various forms within the scope of the following claims.

What is claimed is:

1. An assembly for selectively restricting intake airflow into an internal combustion engine comprising:

a throttle body having a bore through which intake flow passes;

a throttle blade disposed within the bore for selectively restricting the flow through the bore and comprising opposite faces;

one or more through-holes in the blade extending between its faces;

a wedge body having opposite non-parallel faces, one of which is disposed against one face of the blade, and one or more self-attachment features extending from the one face of the wedge body through one of the through-hole in the blade and having a barb that catches the opposite face of the blade at the margin of the through-hole;

wherein the throttle blade is journaled on the throttle body for turning within the throttle body bore about an imaginary centerline that is disposed substantially on a diameter of the throttle body bore, and the wedge body has a perimeter face that extends between its opposite faces and that has a maximum thickness at a location which is substantially equidistant from opposite ends of the diameter on which the imaginary centerline is substantially disposed; and in which the perimeter face, is formed along a substantially circular contoured segment spanning less than a full circle, and a substantially straight segment that forms the remainder of the perimeter face and that is disposed substantially parallel with the imaginary centerline.

2. An assembly as set forth in claim 1 in which the substantially straight segment of the perimeter face has a substantially constant thickness throughout.

3. An assembly as set forth in claim 2 in which the substantially circular contoured segment of the perimeter face progressively increases in thickness from the substantially straight segment to the location where the substantially circular contoured segment has maximum thickness.

4. An assembly as set forth in claim 1 in which the one face of the wedge body and the one face of the throttle blade against which the one face of the wedge body is disposed are both flat, and the opposite non-parallel face of the wedge body is also flat.

5. An assembly as set forth in claim 4 in which the blade comprises two through-holes, each disposed to a respective side of an imaginary plane that passes through the location of maximum thickness of the substantially circular contoured segment of the perimeter face perpendicular to the imaginary centerline, and the wedge comprises two self-attachment features each extending from the one face of the wedge body through a respective one of the two through-holes in the blade to a respective barb that catches the opposite face of the blade around the respective through-hole.

6. An assembly as set forth in claim 5 in which each self-attachment feature comprises two projections that extend perpendicularly from the one face of the wedge body and terminate in respective free distal ends containing respective barbs for catching on diametrically opposite portions of the margin of the respective through-hole at the opposite face of the blade.

7. An assembly as set forth in claim 6 in which the two projections of each self-attachment feature are spaced from each other for allowing their free distal ends to flex toward each other as they engage, and pass through, the respective through-hole as an incident of assembling the wedge to the throttle blade.

8. An assembly as set forth in claim 1 in which the one face of the throttle blade faces upstream of the bore when the blade is in a closed position.

9. A method of assembling a wedge to a throttle blade comprising:

aligning self-attachment features that extend from a body of the wedge with through-holes that extend between opposite faces of the blade; and advancing the wedge and the blade relatively toward each other to introduce free distal ends of the self-attachment features comprising barbs into the through-holes and cause the self-attachment features to resiliently flex as the free distal ends are increasingly passed through the through-holes; and continuing to relatively advance the wedge and the blade until the body of the wedge abuts the one face of the blade and the barbs have passed completely through the through-holes so as to allow the flexed self-attachment features to relax and catch the barbs on the margins of the through-holes at the opposite face of the blade.

* * * * *